US006539946B2

(12) United States Patent
Weyergans

(10) Patent No.: US 6,539,946 B2
(45) Date of Patent: Apr. 1, 2003

(54) ALTERNATING PRESSURE METHOD FOR CELLULITE REDUCTION

(76) Inventor: Rudolf Weyergans, An Gut Boisdorf 8, 52355 Düren-Rölsdorf (DE)

( * ) Notice: Subject to any disclaimer, the term of this patent is extended or adjusted under 35 U.S.C. 154(b) by 0 days.

(21) Appl. No.: 09/901,192

(22) Filed: Jul. 10, 2001

(65) Prior Publication Data

US 2002/0007836 A1 Jan. 24, 2002

Related U.S. Application Data

(63) Continuation-in-part of application No. 09/405,822, filed on Sep. 24, 1999.

(30) Foreign Application Priority Data

Nov. 13, 1998 (DE) ..... 198 52 328

(51) Int. Cl.[7] ..... A61H 7/00
(52) U.S. Cl. ..... 128/898; 601/6
(58) Field of Search ..... 128/897–899, 128/202.12, 205.26; 601/6, 7, 9–12, 201, 204, 204.15, 204.35; 604/313, 319

(56) References Cited

U.S. PATENT DOCUMENTS

| | | | | |
|---|---|---|---|---|
| 4,421,109 | A | 12/1983 | Thornton | 128/25 R |
| 4,428,368 | A | 1/1984 | Torii | 128/38 |
| 5,133,339 | A | 7/1992 | Whalen et al. | 128/25 R |
| 5,228,431 | A | 7/1993 | Giaretto | 128/24 R |
| 5,358,467 | A | 10/1994 | Milstein et al. | 601/10 |
| 5,672,148 | A | 9/1997 | Maunier | 601/148 |
| 5,897,512 | A | 4/1999 | Zagame | 601/6 |
| RE36,958 | E | 11/2000 | Gamow | 128/202.12 |

FOREIGN PATENT DOCUMENTS

| | | | |
|---|---|---|---|
| DE | 43 14 362 A1 | 11/1994 | |
| GB | 2 261 601 A | 1/1991 | A61H/7/00 |

OTHER PUBLICATIONS

The Gale Group, Marketing Intelligence Service Ltd; Advertisement for "Lancome Durable Minceur—Cellulite Relief Gel", Apr. 08, 1991.*

* cited by examiner

*Primary Examiner*—Max. F. Hindenburg
*Assistant Examiner*—Joseph A. Cadugan
(74) *Attorney, Agent, or Firm*—Christopher J. Whewell

(57) ABSTRACT

The invention relates to methods of improving the bodily appearance in the case of cellulite. In order to achieve an effective improvement without the direct contact of sound heads, electrodes or winding foils on the skin the invention suggests that the body or a part of the body of a person is received by a known chamber provided with at least one pump which chamber is subsequently sealed in a gas-tight manner and exposed to the action of an alternating pressure. If the pressure in the chamber is lowered (negative pressure) relative to the atmospheric ambient pressure the lymph vessels widen and receive tissue fluid and residual metabolic products associated with the lymph. The subsequent raising of the pressure in the chamber either to the atmospheric ambient pressure or an excess pressure [superpressure] in the range of a maximum of 20–60 mbar produces a directed flow of lymph and a removal of the residual metabolic products to the filtering organs.

26 Claims, No Drawings

ALTERNATING PRESSURE METHOD FOR CELLULITE REDUCTION

CROSS-REFERENCES TO RELATED APPLICATIONS

This application is a Continuation-In-Part of U.S. patent application Ser. No. 09/405,822 filed on Sep. 24, 1999, currently still pending, the entire contents of which are herein incorporated fully by reference thereto.

FIELD OF THE INVENTION

The present invention relates to improving the appearance of the human body. More particularly, it relates to decreasing the quantity of excess deposits of fat, often referred to as cellulite. The present invention is concerned with the removal of cellulite using a method which includes subjecting a selected portion of the human body to pressure other than atmospheric pressure, and in one preferred form includes the cyclic variation of the pressure that is applied to the portion of the human body selected for cellulite removal between a plurality of prescribed pressure levels.

BACKGROUND

Individuals who are conscious of the appearance of their bodies have had at their disposal many means for improving their appearance. The most basic form of improving the appearance of the human body is through judicious choice of the type and quantity of caloric intake, coupled with some form of physical exertion or exercise. However, owing to predisposed factors such as genetically-controlled metabolism of food eaten, it is known to be more difficult for some individuals to control the appearance of their bodies—namely cellulite.

Local storages of fat, sometimes called "depot fat" occur due to improper nourishment and lack of adequate physical movement of the body in persons of all ages, but most notably in modern times the appearance of fat is becoming more noticeable in persons in the younger age categories, owing to various social factors.

The local storages of fat are often accompanied by cellulite, which resembles an orange peel in its outward appearance. Cellulite has been determined to be inflated fat cells in which waste materials of the metabolic process become stored. Reasons for the formation of cellulite reside in a deficient muscular pumping activity, which for its part is the result of too little movement, or, which is more frequently the case, the result of atonic or flaccid connective tissue. The term "cellulite" includes tissue which has had a local disturbance in the circulation of lymphatic cells due to insufficient muscular pumping activity which otherwise would cause removal of the metabolic waste products and toxins from such tissue.

Many prior art methods and devices have been contrived to alleviate the presence of cellulite, many of which attempt to reduce the storage of fat by activating the lipometabolism. For example, an ultrasonic treatment of the skin areas affected by local storage of fat is described in Beauty Forum, edition of August, 1996—Braun Verlag medizinische Fachzeitschriften GmbH & Co. K G, Karlsruhe: Ultraschall-Behandlung: "Neue Erkenntnisse und Indikationen" [German—Ultrasonic Treatment: "New Findings and Indications"]. The treatment of the skin with ultrasonic waves activates the lipometabolism and waste materials can be removed. The lipometabolism is stimulated in particular by the deep thermal action of the ultrasonic waves. The deep massage which takes place at the same time by the sound waves has a positive action on any cellulite present.

Moreover, a cosmetic electro-physiotherapy is known from Skripten zur Elektrotherapie [German—Publications on Electrotherapy], Otto Steuernagel—Verlag Elektrotherapie Klaus Steuernagel in which physiotherapy electrodes are placed on each skin area in the area of the storages of fat via which current pulse forms are administered which differ in one and the same session.

In Profi Kosmetik-Journal, April 1992—Terra-Verlag, P.O. Box 102144, 7750 Constance: Neu im Institut [German—New in the Institute]: "Body-Wrapping" and GB 2,253,143 A describe body-wrapping. This is a cosmetic method with the aim of reducing storages of fat and of improving the appearance of the skin in the case of cellulite. Moreover, U.S. Pat. No. 4,829,987 teaches the carrying out of body-wrapping with an elastic bandage coated with a mineral solution in combination with a passive movement treatment of the area in question in order to reduce cellulite.

Of the methods of the prior art, none thus far have provided a gentle, yet effective method of improving the bodily appearance in cases where cellulite is present, which method brings about improvements in the bodily appearance without a direct contact with sound heads, electrodes, or winding foils on the skin.

U.S. Pat. No. 4,428,368 teaches a device which comprises a pump for suction and exhaust of air by an electric motor. A crank is provided with a funnel type cup by means of a detachable hose. In use, an open portion of the cup is brought into contact with the part of the human body under pressure in an airtight fashion. Massage stimulation is performed by the air suction causing the surface of the body to swell, and by the air exhaust (discharge) causing the pressure on the surface of the body to return to ambient. Moreover, the cup is provided with an electric heating element to increase the massage stimulation effect by heated air, or an electrode for generating low frequency pulse signal.

U.S. Pat. No. 5,358,467 provides a method of stimulation of a body using a massage device that comprises a housing containing pressure means, an inlet for negative pressure with a plurality of projections located in a region of the inlet, and means for heating and cooling the user, comprising the steps of: 1) applying the housing inlet to a user and applying a negative pressure over a whole part of a body surface; and simultaneously: increasing mechanical pressure on local points distributed over the whole part of the body surface by acting on the local points with the plurality of projections and using the massage device to cool the part of the body surface by interrupting a supply of a fluid matter to the inlet which has been previously heated by the cooling and heating means; 2) maintaining the foregoing over a preset period of time; 3) reducing the negative pressure over the whole part of the body surface; 4) simultaneously with the reduction of negative pressure also reducing the mechanical pressure on the local points over part of the body surface; while warming the part of the body surface by supplying the fluid matter which has been previously heated by the cooling and heating means to the inlet; and 5) maintaining the steps 3 and 4 over a preset period of time.

U.S. Pat. No. 5,672,148 sets forth a hydraulic device for lymphatic drainage and massage of a part of the human body, which device has an enclosure capable of covering said part of the body, and through which a fluid circulates in the desired massage direction and at varying pressures. The enclosure includes a porous medium that is locally deformable so that the fluid circulates therethrough while being subjected to a given headloss at each point of deformation, thus affecting the flow rate and the pressure of the fluid in order to create a massaging effect.

U.S. Pat. No. 5,897,512 discloses a massage appliance for placing on a predetermined zone of the human body, the appliance comprising a generally bell-shaped hollow body having a bottom opening defined by a peripheral edge via which said appliance is applied to the zone to be massaged, said hollow body having at least one internal partition extending substantially to the same level as the plane containing the said peripheral edge so as to define mutually isolated compartments which are connected to a pump member, said at least one partition being disposed in such a manner that the compartments are of significantly different volumes in order to have different degrees of suction in each of said compartments.

U.S. Pat. No. 6,030,318 describes a method for passively exercising a selected portion of a human body, the method comprising the steps of: a) applying a partial vacuum pressure to the selected portion of the human body; b) maintaining the partial vacuum pressure applied to the selected portion of the human body for a first predetermined period of time; c) releasing the partial vacuum pressure so that substantially atmospheric pressure is applied to the selected portion of the human body; d) maintaining the substantially atmospheric pressure applied to the selected portion of the human body for a second predetermined period of time; and e) cyclically repeating steps (a) through (d) to the selected portion of the human body. However, this reference only teaches those cases in which the pressure to which the portion of the body being treated is subjected to are pressures which are either both lower than atmospheric pressure, or those cases in which one pressure is a vacuum pressure and the other pressure is substantially atmospheric pressure. The present invention represents a remarkable increase in performance over the process taught in the '318 patent by the use of superatmospheric pressures as one of the pressure levels between which the pressure applied to the portion of the body to be treated is cycled, as shall be evidenced by the data hereinafter presented.

U.S. Pat. reissue 36,958 sets forth a cylindrically-shaped hypobaric sleeping chamber with a length longer than its diameter having a size sufficient to accommodate no more than two reclining humans, having means for maintaining a selected internal pressure between 0.1 and 10 psi below the local ambient air pressure, and having means for providing fresh air to occupants of said chamber over a period of up to eight hours, said chamber further comprising: (a) an air-impermeable outer layer formed of essentially non-elastomeric material, and an inner frame of rigid or semi-rigid material, said outer is layer and inner frame when formed into said cylindrically-shaped hypobaric chamber having sufficient strength to withstand an external collapsing pressure of approximately 30 psig; (b) a substantially air-tight ingress and egress means through said air-impermeable material of a size sufficient to allow a human to pass therethrough; (c) said means for providing fresh air comprising a vacuum pressure release valve located in said air-impermeable material responsive to a predetermined decrease in said internal pressure within said hypobaric chamber below ambient pressure for pulling fresh ambient air into said chamber; (d) said means for maintaining said selected internal pressure comprising a vacuum maintenance orifice located within said air-impermeable material through which air is removed from said chamber; and (e) said cylindrically-shaped hypobaric sleeping chamber weighing approximately 200 pounds or less.

SUMMARY OF THE INVENTION

The present invention is directed at a process for improving the appearance of a person possessing cellulite. A process according to the invention utilizes a sealable chamber which is capable of receiving the body of a person, excluding the head, or any portion of the body which contains cellulite that is desired to be reduced. The chamber is capable of maintaining any portion of such body at a pressure other than atmospheric pressure. The selected portion of the body that contains cellulite to be reduced is caused to be contained in the sealable chamber and subsequently the chamber is closed gas-tight. According to one preferred form of the invention, both legs and a portion of the abdomen are caused to be contained in the chamber, in such a way as to prevent the lymphatic vessels from being caught by a seal of the chamber. The pressure within the chamber is next caused to be reduced to a pressure lower than atmospheric pressure to a pre-selected level of pressure conveniently referred to as the "threshold pressure" level. The pressure within the chamber is next caused to be elevated to a pressure greater than the threshold pressure, which in a preferred embodiment is a pressure that is greater than atmospheric pressure, and most preferably in the range of about 20 to 60 mbar in excess of atmospheric pressure. The levels of pressure to which the portion of the body that contains cellulite to be reduced is exposed is alternated between the threshold pressure and the pressure that is greater than the threshold pressure for an effective number of times for improving the appearance of said person possessing cellulite by reducing the amount of cellulite present. Finally the pressure within the chamber is caused to return to atmospheric pressure, and the treatment is ceased.

DETAILED DESCRIPTION

The present invention utilizes alternating pressures applied to selected portions of a human body to effect reduction of cellulite. According to one of the preferred forms of the invention, the body or a part of the body of a person is received by a chamber that is connected to at least one pump, which chamber is subsequently closed gas-tight. The pressure is subsequently lowered by 35 to 80 mbar relative to the atmospheric ambient pressure, and is caused to alternate between just above atmospheric ambient pressure and the lowered pressure.

According to another preferred form of the invention, the body or a part of the body of a person is received by a chamber that is connected to at least one pump, which chamber is subsequently closed gas-tight, and the pressure in the chamber is alternately lowered by 35 to 80 mbar, and elevated by 20 to 60 mbar relative to the atmospheric ambient pressure.

Each of the aforesaid preferred embodiments make use of the action of the alternating pressures applied to the body or a selected portion thereof. When the pressure in the chamber is lowered (negative pressure) relative to the atmospheric ambient pressure, the lymphatic vessels widen and receive tissue fluid and residual metabolic products associated with the lymph. The subsequent raising of the pressure in the chamber to a super-atmospheric pressure, in the range of a maximum of 20–60 mbar, produces a directed flow of lymph and a removal of the residual metabolic products in the direction of the filtering organs on account of the lymph flaps in the lymphatic vessels. The alternation between negative pressure and a super-atmospheric pressure facilitates or maintains the removal of the residual metabolic products.

A maximum negative pressure of 35 mbar, or a pressure level slightly higher than such and an excess pressure of 20 mbar or slightly higher than such is recommended in particular in the cases where it is desired to reduce the amount of atonic connective tissue, whereas higher maximum negative and excess pressures up to a maximum of 80 mbar negative pressure and 60 mbar excess pressure are admissible in the case of fairly tense connective tissue.

One main emphasis of the preferred methods according to the invention is the generation of a negative pressure, and that the generation of an excess pressure. The generation of an excess pressure improves the lymphatic flow. However, the use of excess pressure may not be used, or may be used judiciously, in the discretion of the supervising physician, for reasons including those such as previous illnesses, especially of the cardiovascular system.

In order to achieve optimum results in the treatment of cellulite it is also advantageous to maintain not only the obligatorily prescribed ranges for the minimum and maximum pressure but also to prescribe or select the time span in which the pressure in the chamber alternates between its minimum and its maximum in a range of 20–120 seconds. The preferred time period at which each of the pressure lower than atmospheric pressure and the pressure greater than the threshold pressure is any amount of time in the range of between 2 seconds and 10 seconds, with any amount of time in the range of between 3 seconds and 7 seconds being more preferred, with a time of about 5 seconds being most preferred.

German Patent Application DE 28 39 283 A1 discloses a chamber with which the method of the invention can be carried out with advantage. This publication describes a container for medical treatments. The container, which serves to receive the body or an extremity of the subject, comprises a cuff on a wall which cuff has a sealing opening passage for the body or an extremity of the subject. The cuff brings about the seal of the through passage for the body or the extremity of the subject through the container wall.

After the body or the extremity is located in the container or in the chamber the latter is closed in an airtight manner and a negative pressure generated in it. Statements about the psychomotor behavior and circulatory behavior of the human body can be made thereby on account of the lowered partial pressure of air and oxygen. In such a device, e.g., the lower body, from the hip down, or an extremity of the subject is exposed to the effect of the negative pressure.

Another device for medical treatments, investigations and tests with a chamber which can be connected to a source of negative pressure results, e.g., from DE 34 37 461 C1. In contrast to the chamber according to DE 28 39 283 A1 this chamber is collapsible.

In addition to these known devices the use of a lower-body negative-pressure (LBNP) device has proven in tests to be advantageous which device is operated, deviating from the method of operation provided for it. Controls for generating an alternating pressure in the chamber of the LBNP device are familiar to an expert in the art. The LBNP device was developed within the framework of the neurolab research program of the NASA of the German Space Agency (DARA). The neurolab research program is concerned primarily with the investigation of the human nervous system. References to the LBNP device are found in the NASA publication "Neurolab" as well as in Focus 35 of Aug. 24, 1998, p. 138.

The elastic cuff provided in the known chambers for sealing off from the body or the extremity can be replaced by a disposable foil wrapping which seals off the passage out of the chamber from the extremity. The foil wrapping also bridges rather large differences between the body or the extremity and the passageway. Moreover, the disposable foil offers hygienic advantages over the cuff.

The success of a treatment method according to the present invention can be significantly increased if the person to be treated drinks an amount of liquid of at least 2.5 liters at least on the day of treatment, which is preferably water, but may include any other potable liquid.

Tabulated in the tables below are bodily measurement data gathered at various stages of treatment of portions of the bodies of seven different patients, in three separate sets of differing applied pressures.

Table I shows the results of applied pressure on patient h. In this table, the designation ϕphase A and ϕphase B refer to the levels of pressure applied to the portion of the patients body. In the case of patient h, the level of the applied pressure which is lower than atmospheric pressure (threshold pressure) is −30 mbar below atmospheric pressure, and the level of the applied pressure which is higher than the threshold pressure is +30 mbar above atmospheric pressure. Readings of different parts of the body were taken on the dates indicated, in which the readings are measurements, in centimeters. The reading designated as "b" is the narrowest portion on the lower leg, the ankle measurement. The reading designated as "g" is the thickest portion on the upper leg, the thigh measurement. The reading designated as "t" is the narrowest portion of the abdomen, or the waist measurement. This same convention is used in all of tables I, II, and III.

Thus, per the tables, the data in Table I were gathered on a patient ("h") treated at cycling pressures having magnitudes of −30 mbar and +30 mbar at various points in time. An example of this type can be conveniently referred to as "hypo/hyper" pressure experiment, since one of the pressures is hypo-atmospheric and the other is hyper-atmospheric.

The data in Table II were gathered on a patient ("a") treated at cycling pressures having magnitudes of −30 mbar and −10 mbar with respect to atmospheric pressure at various points in time, that is, the selected portions of patient a were cyclically treated with alternating between these two different pressures which were both below atmospheric pressure, as suggested by the prior art reference of Howard. An example of this type can be conveniently referred to as a "hypo/hypo" pressure experiment, since both pressures are is hypo-atmospheric.

The data in Table III were gathered on a patient ("o") treated at cycling pressures having magnitudes of −30 mbar with respect to atmospheric pressure and atmospheric pressure at various points in time, that is, the selected portions of patient o were cyclically treated with alternating between these two different pressures, one of which was below atmospheric pressure, and the other of which was atmospheric pressure, as suggested by the prior art reference of Howard. An example of this type can be conveniently referred to as a "hypo/normal" pressure experiment, since one pressure is below atmospheric and the other is atmospheric or "normal" pressure.

It is immediately recognizable that patient h which was treated under the hypo/hyper regiment had undergone a 5.03% reduction in size over about a 19 day treatment. This is a remarkable result, as evidenced by comparison of the results of the patients treated under the hypo/hypo and hypo/normal regiments, who had undergone size reductions of 2.87% and 1.70% respectively. In fact, the results of the regiment of hypo/hyper are surprising and unexpected, if one considers that the only difference between the hypo/hypo and hypo/normal regiments was the changing of the ϕphase B value. From Tables II and III which represent methods suggested by the prior art, one would be led to predict that as the ϕphase B value is increased from −10 mbar in Table II to 0 mbar in Table III, a decrease in the reduction in size is seen (goes from 2.87% to 1.70%), i.e., a poorer result is increased. However, in direct contradistinction thereto, when a higher pressure of +30 mbar w/respect to atmospheric is used as in the hypo/hyper case, the reduction in size is dramatically increased, thus providing superior results over the prior art methods.

To ensure that these results are in fact statistically meaningful, the same general treatment conditions of treatment of persons under the hypo/hyper, hypo/hypo, and hypo/normal regiments were repeated for a series of seven patients in each such case using slightly varying levels of reduced and elevated pressures, as set forth in Tables IV, V, and VI respectively. From these tables, it is immediately recognized that the case of the hypo/hyper treatment provides an average size reduction of 6.30%; the hypo/hypo treatment regiment provides an average size reduction of 2.62%; and the hypo/normal treatment provides an average size reduction of 3.63%, thus showing that on average the method of the present invention is capable of a size reduction of a patient which is about double in magnitude over prior art methods.

TABLE I bodily measurements for patient h

| | Date | I phase A | I phase B | b | g | t | $PO_2$ before | $PO_2$ after |
|---|---|---|---|---|---|---|---|---|
| | 18 May | −30 | +30 | 21 | 57 | 81 | 29 | 40 |
| | 21 May | −30 | +30 | 21 | 55 | 80 | 29 | 39 |
| | 26 May | −30 | +30 | 21 | 55 | 79 | 30 | 42 |
| | 27 May | −30 | +30 | 21 | 54 | 78 | 32 | 41 |
| | 29 May | −30 | +30 | 22 | 55 | 80 | 29 | 36 |
| | 3 June | −30 | +30 | 20 | 53 | 78 | 30 | 41 |
| | 6 June | −30 | +30 | 20 | 53 | 78 | 32 | 39 |
| ϕ | 7 | | | | | | 211 | 278 |
| | | | | | | | +31.75 | |
| Δ | | | | 1 | 4 | 3 | | |

[(b + g + t)final] − [(b + g + t)initial] = 159−151 = 8
[8/(b + g + t)initial] × 100 = 5.03% reduction in size

TABLE II bodily measurements for patient a

| | Date | I phase A | I phase B | b | g | t | $PO_2$ before | $PO_2$ after |
|---|---|---|---|---|---|---|---|---|
| | 18 May | −30 | −10 | 22 | 63 | 89 | 32 | 36 |
| | 21 May | −30 | −10 | | | | 29 | 32 |
| | 26 May | −30 | −10 | 22 | 61 | 87 | 31 | 36 |
| | 29 May | −30 | −10 | | | | 31 | 36 |
| | 30 May | −30 | −10 | | | | 30 | 35 |
| | 3 June | −30 | −10 | | | | 29 | 37 |
| | 9 June | −30 | −10 | 22 | 61 | 86 | 29 | 36 |
| ϕ | 7 | | | | | | 211 | 248 |
| | | | | | | | +17.54% | |
| Δ | | | | 0 | 2 | 3 | | |

[(b + g + t)final] − [(b + g + t)initial] = 174−169 = 5
[5/(b + g + t)initial] × 100 = 2.87% reduction in size

TABLE III bodily measurements for patient o

| | Date | I phase A | I phase B | b | g | t | $PO_2$ before | $PO_2$ after |
|---|---|---|---|---|---|---|---|---|
| | 17 May | −30 | 0 | 23 | 67 | 86 | 26 | 31 |
| | 18 May | −30 | 0 | 23 | 66 | 85 | 27 | 32 |
| | 21 May | −30 | 0 | 22 | 66 | 85 | 27 | 32 |
| | 26 May | −30 | 0 | 22 | 66 | 85 | 27 | 36 |
| | 29 May | −30 | 0 | 22 | 66 | 84 | 28 | 33 |
| | 3 June | −30 | 0 | 22 | 67 | 85 | 26 | 33 |
| | 6 June | −30 | 0 | 22 | 66 | 85 | 28 | 33 |
| ϕ | 7 | | | | | | 189 | 220 |
| | | | | | | | +21.69% | |
| Δ | | | | 1 | 1 | 1 | | |

[(b + g + t)final] − [(b + g + t)initial] = 176−173 = 3
[3/(b + g + t)initial] × 100 = 1.70% reduction in size

TABLE IV results from application of hypo/hyper pressure levels

| | Patient | I phase A | I phase B | I $PO_2$ (%) before | I $PO_2$ (%) after | Size Reduction (%) |
|---|---|---|---|---|---|---|
| | h | −30 | +30 | | +31.8 | −5.03 |
| | i | −30 | +40 | | +29.0 | −6.84 |
| | j | −40 | +30 | | +36.8 | −4.70 |
| | k | −45 | +40 | | +39.4 | −7.41 |
| | l | −30 | +30 | | +38.3 | −4.18 |
| | m | −40 | +40 | | +32.6 | −8.29 |
| | n | −50 | +50 | | +42.2 | −7.62 |
| ϕ | 7 | −37.9 | +37.2 | | 36.44% | 6.30% |

TABLE V results of application of hypo/hypo pressure levels

| | Patient | I phase A | I phase B | I $PO_2$ (%) before | I $PO_2$ (%) after | Size Reduction (%) |
|---|---|---|---|---|---|---|
| | a | −30 | −10 | | +12.5 | −2.87 |
| | b | −40 | −20 | | +12.6 | −3.50 |
| | c | −40 | −10 | | +15.7 | −4.63 |
| | d | −30 | −20 | | +11.0 | 0 |
| | e | −30 | −10 | | +18.8 | −2.19 |
| | f | −40 | −20 | | +16.7 | −1.64 |
| | g | −40 | −10 | | +21.0 | −3.50 |
| ϕ | 7 | 250/−35.7 | 100/−14.3 | | 16.2% | 2.62% |

TABLE VI results from application of hypo/normal pressure levels.

| | Patient | I phase A | I phase B | I $PO_2$ (%) before | I $PO_2$ (%) after | Size Reduction (%) |
|---|---|---|---|---|---|---|
| | o | −30 | 0 | | +21.7 | −1.70 |
| | p | −40 | 0 | | +27.9 | −4.61 |
| | q | −45 | 0 | | +28.0 | −3.62 |
| | r | −50 | 0 | | +26.5 | −5.70 |
| | s | −30 | 0 | | +23.4 | −1.81 |
| | t | −40 | 0 | | +22.7 | −4.32 |

TABLE VI-continued results from application of hypo/normal pressure levels.

| | Patient | I phase A | I phase B | I $PO_2$ (%) before | I $PO_2$ (%) after | Size Reduction (%) |
|---|---|---|---|---|---|---|
| | u | −50 | 0 | | +26.5 | −3.62 |
| ϕ | 7 | −40.7 | 0 | | 25.3% | 3.63% |

For the data in tables I–VI, the portion of the body treated was exposed each to the indicated levels of pressure for 5 seconds before being alternated to the other pressure indicated. In each case, three of the patients were male, and four of the patients were female. Further, the oxygen partial pressure, $\phi PO_2$ in the area of the ankle joint in each case with the patient lying down after the treatment had been carried out using a Klark's probe and a standardized device calibrated to the daily pressure in the area of the ankle joint when lying down, to illustrate the increase in blood flow in the area, as indicated by the presence of oxygen. From the date in the various charts, the same superior result for the oxygen partial pressure in the case of the hypo/hyper treatment regiment can be seen throughout the data. Table VII below summarizes these results, setting for the average values for ϕPhase A, ϕPhase B, $\phi PO_2$, and the % reduction in size for each of the cases:

TABLE VII summary of results from tables IV, V, and VI

| Group | n | I phase A | I phase B | I $PO_2$ | I reduction/size |
|---|---|---|---|---|---|
| hypo/hypo | 7 | −35.7 | −14.3 | +16.2% | −2.62% |
| hypo/normal | 7 | −40.7 | 0 | +25.3% | −3.63% |
| hypo/hyper | 7 | −37.9 | +37.1 | +36.4% | −6.30% |

and shows once again the superior results of the methods according to the present invention.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

I claim:

1. A process for reducing cellulite in a person possessing cellulite, which comprises the steps of:

i) providing a sealable chamber which is capable of receiving the body of a person excluding the head, and which chamber is capable of maintaining any portion of such body at a pressure other than atmospheric pressure;

ii) causing a portion of said body to be contained in said sealable chamber and subsequently closing said chamber gas-tight;

iii) causing the pressure within said chamber to be reduced to a pressure lower than atmospheric pressure to a threshold pressure level;

iv) causing the pressure within said chamber to be elevated to a pressure greater than atmospheric pressure; and v) repeating steps iii) and iv) above an effective number of times for improving the appearance of said person possessing cellulite, and finally causing the pressure within said chamber to return to atmospheric pressure.

2. A process according to claim 1 wherein said portion of said person possessing cellulite includes the abdomen of said person.

3. A process according to claim 1 wherein said portion of said person possessing cellulite includes the arms of said person.

4. A process according to claim 1 wherein said portion of said person possessing cellulite includes the abdomen and at least one of the arms of said person.

5. A process according to claim 1 wherein said portion of said person possessing cellulite includes the abdomen and at least one of the legs of said person.

6. A process according to claim 1 wherein said pressure greater than atmospheric pressure is greater than atmospheric pressure by an amount of at least 20 mbar.

7. A process according to claim 1 wherein said threshold pressure level is less than atmospheric pressure by any amount in the range of 20 mbar to 60 mbar, and integer every mbar therebetween.

8. A process according to claim 7 wherein said pressure greater than atmospheric pressure is greater than atmospheric pressure by an amount in the range of 20 mbar to 60 mbar, and every integer mbar therebetween.

9. A process according to claim 1 wherein the amount of time elapsed from when the pressure within said chamber is at its minimum and its maximum is in the range of 20 to 120 seconds, including every integral second therebetween.

10. A process according to claim 1 wherein the amount of time that said portion of a human body which contains cellulite is maintained at each of said pressure levels is any amount of time in the range of between 2 seconds and 10 seconds.

11. A process according to claim 1 wherein said person is provided with an amount of liquid of at least 2.5 liters on the day during which said process is undertaken.

12. A process for reducing cellulite in a person possessing cellulite, which comprises the steps of:

i) providing a sealable chamber which is capable of receiving an extremity of the human body, and which chamber is capable of maintaining such extremity of the human body at a pressure other than atmospheric pressure;

ii) causing a portion of said body to be contained in said sealable chamber and subsequently closing said chamber gas-tight;

iii) causing the pressure within said chamber to be reduced to a pressure lower than atmospheric pressure to a threshold pressure level;

iv) causing the pressure within said chamber to be elevated to a pressure greater than atmospheric pressure; and v) repeating steps iii) and iv) above an effective number of times for improving the appearance of said person possessing cellulite, and finally causing the pressure within said chamber to return to atmospheric pressure.

13. A process according to claim 12 wherein said portion of said person possessing cellulite includes the abdomen of said person.

14. A process according to claim 12 wherein said portion of said person possessing cellulite includes at least one of the arms of said person.

15. A process according to claim 12 wherein said portion of said person possessing cellulite includes the abdomen and at least one of the arms of said person.

16. A process according to claim 12 wherein said portion of said person possessing cellulite includes the abdomen and at least one of the legs of said person.

17. A process according to claim 12 wherein said pressure greater than atmospheric pressure is greater than atmospheric pressure by an amount of at least 20 mbar.

18. A process according to claim 12 wherein said threshold pressure level is less than atmospheric pressure by any amount in the range of 20 mbar to 60 mbar, and integer every mbar therebetween.

19. A process according to claim 18 wherein said pressure greater than atmospheric pressure is greater than atmospheric pressure by an amount in the range of 20 mbar to 60 bar, and every integer mbar therebetween.

20. A process according to claim 12 wherein the amount of time elapsed from when the pressure within said chamber is at its minimum and its maximum is in the range of 20 to 120 seconds, including every integral second therebetween.

21. A process according to claim 12 wherein the amount of time that said portion of a human body which contains cellulite is maintained at each of said pressure lower than atmospheric pressure and said pressure greater than atmospheric pressure is any amount of time in the range of between 2 seconds and 10 seconds.

22. A process according to claim 12 wherein said person is provided with an amount of liquid of at least 2.5 liters on the day during which said process is undertaken.

23. A process for reducing cellulite in a person possessing cellulite, which comprises the steps of:

i) providing a sealable chamber which is capable of receiving a portion of a human body which contains cellulite, and which chamber is capable of maintaining such portion of a human body at a pressure other than atmospheric pressure ii) causing a portion of said person possessing cellulite to be contained in said sealable chamber, wherein said portion includes at least one lower extremity and at least part of the abdomen of said person;

iii) causing the pressure within said chamber to be reduced to a pressure lower than atmospheric pressure to a threshold pressure level;

iv) causing the pressure within said chamber to be elevated to a pressure greater than atmospheric pressure; and v) repeating steps iii) and iv) above an effective number of times for improving the appearance of said person possessing cellulite, and finally causing the pressure within said chamber to return to atmospheric pressure.

24. A process according to claim 23 wherein the amount of time that said portion of a human body which contains cellulite is maintained at each of said pressure lower than atmospheric pressure and said pressure greater than atmospheric pressure is any amount of time in the range of between 2 seconds and 10 seconds.

25. A process for reducing cellulite in a person possessing cellulite, which comprises the steps of:

i) providing a sealable chamber which is capable of receiving a portion of a human body which contains cellulite, and which chamber is capable of maintaining such portion of a human body at a pressure other than atmospheric pressure;

ii) causing a portion of said person possessing cellulite to be contained in said sealable chamber, wherein said portion includes the lower extremities and at least parts of the abdomen of said person;

iii) causing the pressure within said chamber to be reduced to a reduced pressure lower than atmospheric pressure to a threshold pressure level;

iv) causing the pressure within said chamber to be elevated to an elevated pressure greater than atmospheric pressure; and v) alternating the pressure between said reduced pressure and said elevated pressure an effective number of times for improving the appearance of said person possessing cellulite, and finally causing the pressure within said chamber to return to atmospheric pressure, wherein said reduced pressure is less than atmospheric pressure by any amount in the range of 20 mbar to 60 mbar, and every integral mbar therebetween, and wherein said pressure greater than atmospheric pressure is greater than atmospheric pressure by any amount in the range of 20 mbar to 60 mbar, and every integral mbar therebetween, and wherein the amount of time that said portion of a human body which contains cellulite is maintained at each of said reduced pressure and said elevated pressure is any amount of time in the range of between 2 seconds and 10 seconds.

26. A process according to claim 25 wherein portion of said person possessing cellulite comprises the abdomen and both legs.

* * * * *